United States Patent [19]

Greenwood

[11] Patent Number: 5,005,223

[45] Date of Patent: Apr. 9, 1991

[54] FOLDABLE TOILET SEAT

[75] Inventor: Mark H. Greenwood, Arlington Heights, Ill.

[73] Assignee: Children On The Go, Inc., Wheeling, Ill.

[21] Appl. No.: 509,028

[22] Filed: Apr. 13, 1990

[51] Int. Cl.[5] ..... A47K 13/14

[52] U.S. Cl. ..... 4/235; 4/239; 4/242

[58] Field of Search ..... 4/235, 237, 239, 242, 4/DIG. 8; 297/219, 250, 255

[56] References Cited

U.S. PATENT DOCUMENTS

| | | | |
|---|---|---|---|
| 52,581 | 2/1866 | Sandheim | 4/239 |
| 82,636 | 9/1868 | Perkins | 4/239 |
| 310,401 | 1/1885 | Fox | 4/239 |
| 747,960 | 12/1903 | Franken | 4/242 |
| 1,015,741 | 1/1912 | Parker | 4/239 |
| 1,156,629 | 10/1915 | Rivera | 4/239 |
| 1,167,201 | 1/1916 | Moren | 4/243 |
| 1,283,533 | 11/1918 | Leighton | 4/245 |
| 1,410,427 | 3/1922 | Turnquist | 4/239 |
| 1,592,597 | 7/1926 | Becker | 4/242 |
| 1,633,222 | 6/1927 | Noble | 4/239 |
| 2,443,068 | 6/1948 | Dahle | 4/239 |
| 2,742,650 | 4/1956 | Mohun et al. | 4/242 |
| 3,348,243 | 10/1967 | Kelly | 4/245 |
| 4,525,880 | 7/1985 | Bass | 4/244 |

FOREIGN PATENT DOCUMENTS

| | | | |
|---|---|---|---|
| 449763 | 9/1927 | Fed. Rep. of Germany | 4/239 |
| 484058 | 8/1953 | Italy | 4/239 |
| 9798 | of 1893 | United Kingdom | 4/239 |
| 14447 | of 1899 | United Kingdom | 4/239 |

*Primary Examiner*—Henry J. Recla
*Assistant Examiner*—Robert M. Fetsuga
*Attorney, Agent, or Firm*—Olson & Hierl

[57] ABSTRACT

A foldable, portable toilet seat is provided having foldable front and rear sections that are pivotably connected by hinges. The lower surface of each front section includes a downwardly extending flange for engaging a conventional toilet seat to prevent slipping or movement. The flange of each front section interfits within a hollow raised portion of the corresponding rear section when the sections are folded for convenient transport and storage.

20 Claims, 1 Drawing Sheet

FOLDABLE TOILET SEAT

FIELD OF THE INVENTION

This invention relates to a foldable, portable toilet seat specifically designed for use by children.

BACKGROUND OF THE INVENTION

A number of foldable, portable toilet seats have been disclosed for use by children undergoing toilet training and by travelers who encounter unpleasant sanitary conditions at toilet facilities.

For example, U.S. Pat. No. 1,156,629 to Rivera describes a collapsible, portable toilet seat cover having foldable hinged sections which include a latching mechanism comprising a small metal bar that is inserted into two sections of the seat for stability when the seat is unfolded.

U.S Pat. No. 1,167,201 to Moren discloses a portable toilet seat comprising four sections that are hingably connected together and can be folded parallel to one another for compact transport.

U.S. Pat. No. 1,410,427 to Turnquist describes a foldable, portable toilet seat for a child which includes four hinged sections and locking means to secure the unfolded sections together.

U.S. Pat. No. 1,633,222 to Noble relates to a foldable toilet seat suitable for use by children which includes a plurality of collapsible sections connected by hinges.

U.S. Pat. No. 2,443,068 to Dahle describes a foldable, portable toilet seat for children which can be placed over a conventional toilet seat. The seat includes hinges which join sections having angled edges which prevent pinching of the user.

U.S. Pat. No. 2,742,650 to Mohun et al. describes a portable and foldable toilet seat including a plurality of finger-like elements which join a pair of sections. The finger-like elements extend through notches of each section to form an overlapping arrangement with the opposite section.

U.S. Pat. No. 4,525,880 to Bass describes a portable seat that fits snugly over the top of a toilet seat to prevent slippage. The seat has four sections with hinges which provide for convenient folding and storage of the portable seat.

When providing portable toilet seats for children, in particular, there is a need for a seat construction which prevents pinching of the skin. Moreover, the seat should be easily attachable to a conventional toilet seat in a manner which prevents slippage or movement of the seat. The foldable, portable toilet seat of the present invention meets these requirements.

SUMMARY OF THE INVENTION

The present invention relates to a foldable, portable toilet seat that is comfortable for the user and is stable when placed over a conventional toilet seat.

Some of the desirable features of the device include an overlapping, foldable construction that prevents pinching of the skin, and a pair of front sections with a flange extending downwardly at the forward edge of each front section to securely position the device on a conventional toilet seat. The flanges along with a plurality of non-slip rubberized pads on the lower surface of the device prevent the seat from slipping or moving.

In addition, a pair of rear sections pivotably connected to the corresponding front sections define a hollow raised portion. The hollow lower surface of the raised portion receives the flanges of the front sections when the device is folded into a substantially flat configuration for convenient storage.

More specifically, the foldable, portable toilet seat of this invention includes a pair of rear sections having upper and lower surfaces, forward edges and contiguous edges substantially along the longitudinal center or axis of the seat. The seat also includes a pair of front sections having upper and lower surfaces and rear edges contiguous with the forward edges of the rear sections and positioned substantially along the transverse center or axis of the seat. The front sections can include confronting inner edges at the forward end thereof which are spaced-apart to form a gap between the front sections.

The sections are pivotably connected by hinge means. The lower surface of one section overlaps the edge of the upper surface of an adjacent section to prevent pinching of the user's skin. This overlapping relationship substantially extends the edge of one section over the edge of an adjacent section to completely cover the joint and hinge area where the sections meet.

A flange extends downwardly from the forward edge of the lower surface of each front section to engage the conventional toilet seat. The flanges engage the front portion of the conventional toilet seat to prevent movement of the device and to provide stability.

A hollow raised portion extends upwardly from the upper surface of the rear sections. The hollow raised portion corresponds to the shape of and receives the flange of the front sections when the sections are folded. In particular, the front sections are foldable so that the lower surfaces of the front and rear sections contact each other. The rear sections, with the front sections folded therein, can be pivoted along the hinge means at the longitudinal center of the seat so that the rear sections can be folded to a position substantially parallel to one another.

To use the foldable, portable toilet seat, the sections are unfolded to form the seat. The seat is then placed on a conventional toilet seat. The downwardly extending flange on the front section engages the front portion of the conventional toilet seat to provide stability. After use, the foldable seat is removed from the conventional toilet seat and folded along the hinge means transverse to the center of the toilet seat so that the downwardly extending flanges of the front sections fit within the hollow raised portion of the corresponding rear sections. The rear sections are then folded along the hinge means at the longitudinal center of the seat to provide a compact assembly for efficient transport and storage.

Thus, a comfortable, easy to store, and portable toilet seat is provided. The device reduces the possibility of pinching the skin of the user during use. And the device can be securely positioned on a conventional toilet seat in a stationary but easily removable manner.

BRIEF DESCRIPTION OF THE DRAWINGS

In the accompanying drawings, which form a portion of this disclosure.

DETAILED DESCRIPTION OF A PREFERRED EMBODIMENT

Figure 1:
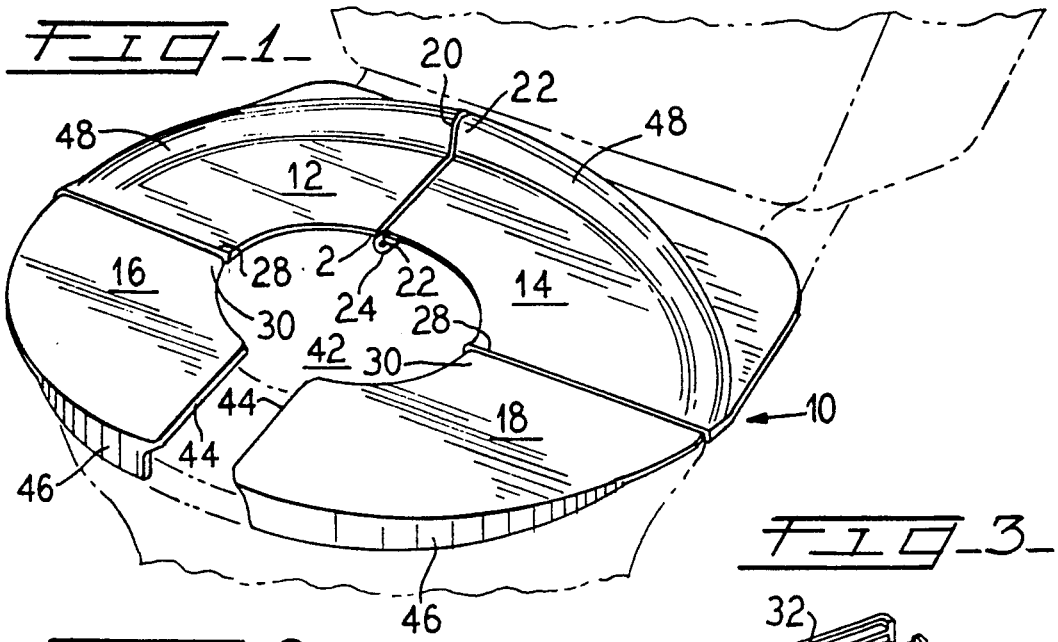
FIG. 1 is a perspective view of one embodiment of the foldable, portable toilet seat.

Referring to FIG. 1, a preferred embodiment of a foldable, portable toilet seat according to the present invention, which is designated generally by reference numeral 10, is shown in an unfolded form. The portable, foldable toilet seat of the invention comprises four sections which are pivotably connected so that they can be folded together along the longitudinal and transverse centers of the seat. The sections of the seat may be made from any lightweight, semi-rigid material such as plastic. If plastic is used to make the sections, the sections may be injection molded or made by any other suitable method.

Figure 4:
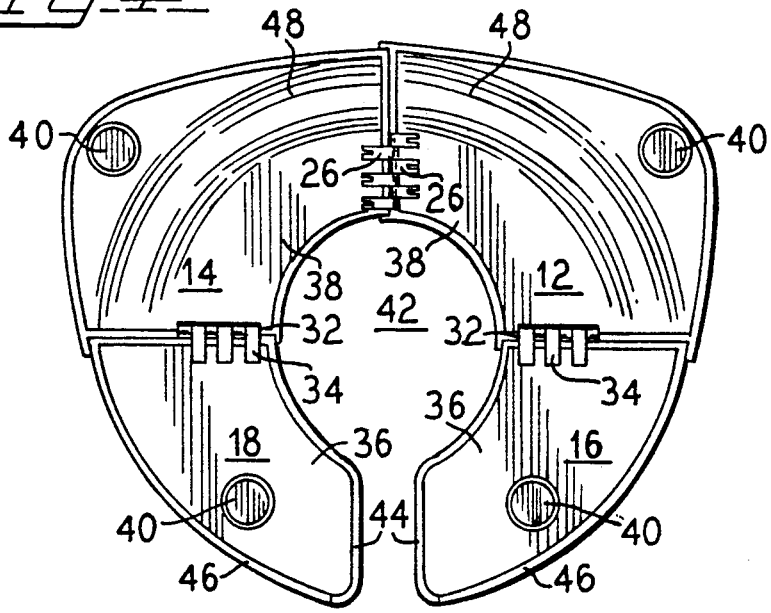
FIG. 4 is a bottom view of the foldable, portable toilet seat.

In particular, the foldable, portable toilet seat includes a pair of rear sections 12 and 14, and a pair of front sections 16 and 18. The rear sections include longitudinally extending contiguous edges 20 and 22 substantially at the longitudinal center of the seat. The rear sections 12 and 14 are pivotably connected together along contiguous edges 20 and 22 by connecting or hinge means 24 which is preferably positioned along the lower surface of the sections as shown in FIG. 4.

The connecting means can comprise any hingable attachment for pivotably moving the sections of the seat 10. For example, connecting means 24 can include a plurality of interlocking support members 26 (see FIG. 4). The support members extend laterally from the edge of each section on the lower surface thereof and are connected by a pin (not shown) so that the adjacent sections can be folded together.

The rear sections also include forward edges 28. The front sections 16 and 18 include rear edges 30 which are contiguous with the forward edges 28 of rear sections 12 and 14 substantially along the transverse center of the seat. Connecting or hinge means 32 with support members 34 is secured to the lower surface 36 of each front section and the lower surface 38 of each rear section to pivotally connect the sections along their contiguous edges. (See FIGS. 2 and 4.) In this manner, the front sections 16 and 18 can be folded against the rear sections 12 and 14. When folded, the lower surfaces 36 of the front sections 16 and 18 contact the lower surfaces 30 of the corresponding rear sections 12 and 14.

Connecting or hinge means 24 and 32 should be sturdy and reliable. Moreover, the hinge means should be appropriate for bearing weight and should be easily foldable. The support members associated with the hinge means distribute the weight load and provide the required flexibility.

Non-slip means 40, which may include rubber pads, are attached to lower surfaces 36 and 38 prevent sliding of the portable toilet seat when it is placed on a conventional seat. (See FIG. 4.) The non-slip means can also serve as a cushion for the portable seat when placed on the conventional seat.

Figure 2:
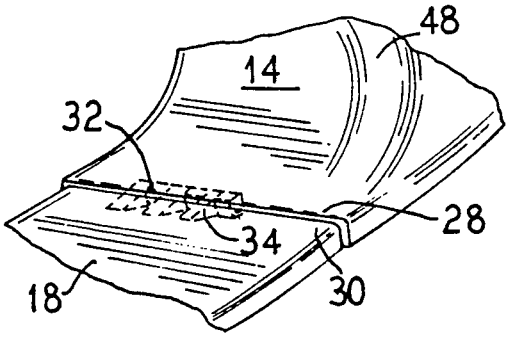
FIG. 2 is an enlarged perspective view of the overlapping upper surface of the rear section at the hinge of the transverse center of the seat.

In order to prevent pinching the skin of the intended user, a child undergoing toilet training, the forward edge 28 of each rear section 12 and 14 overlaps the rear edge 30 of the corresponding front section 16 and 18 as shown in FIG. 2. In addition, the contiguous edge 20 of the rear section 12 overlaps the contiguous edge 22 of rear section 14. The overlapping of the respective edges provides a substantially smooth surface on upper surfaces of the device and eliminates any area that could pinch the skin of the user.

The front and rear sections define an opening 42 of the desired configuration in the portable seat which is preferably symmetrical. Moreover, the confronting or opposite inner edges 44 of the front sections 16 and 18 can be spaced apart to form a gap therebetween.

A flange 46 extends at an angle and preferably downwardly from the forward edge of each front section 16 and 18 as shown in FIG. 1. Each flange 46 is preferably perpendicular to the plane of the front section. The flanges 46 engage the front portion of a conventional toilet seat to prevent slipping or movement of the device during use.

Hollow raised portions 48 are defined in the upper surface of rear sections 12 and 14. The hollow raised portions provide additional support for the user. The user typically exerts pressure against hollow raised portions 48 when in a seated position. The pressure applied to the raised portions causes flanges 46 to more firmly engage the front portion of the conventional toilet seat and prevent movement. Further, the lower surfaces 38 of the rear sections 12 and 14 (in particular, the hollow raised portions 48) are adapted to receive the flanges 46 of the front sections 16 and 18 when the seat is folded.

In addition, the hollow raised portions 48 increase the strength and integrity of the device particularly when it is placed over the opening of the toilet. The weight of a child places a considerable amount of pressure on the hinge means 24 and the rear sections 12 and 14. The hollow raised portions 48 decrease the flexibility and increase the strength of the rear sections. Moreover, the surfaces 50 where the raised portions meet provide an increased surface area for contact between the rear sections 12 and 14. This reduces the possibility of hinge failure and inversion of the sections during use of the device.

Figure 3:
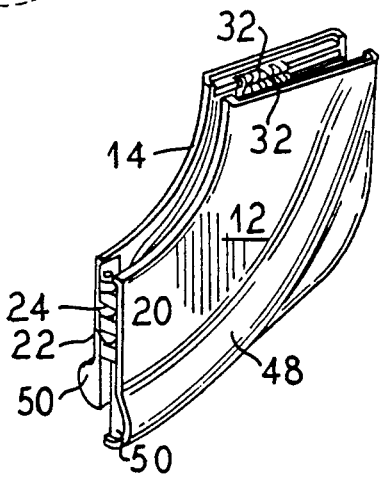
FIG. 3 is a perspective view of the portable toilet seat in a fully folded position.

The relationship of the flanges 46 along the forward edges of front sections 16 and 18 within the corresponding raised portions 46 upon folding of hinge means 32 enables the sections to be folded in a compact manner. When front sections 16 and 18 are pivotably moved about hinge means 32, the flanges 46 of front sections 16 and 18 are received within the hollow raised portions 48 of the rear sections 12 and 14 in an interfitting manner. The rear sections 12 and 14 can be pivotably moved about hinge means 24 so they can be folded in a parallel relationship into a relatively small, compact size, as shown in FIG. 3. The small size of the folded toilet seat provides for convenient transport and storage.

When the seat 10 is to be used, it is unfolded to the shape shown in FIG. 1. Flanges 46 are secured over the front portion of the conventional toilet seat to stabilize the portable seat. As shown in FIG. 4, non-slip means 40 grip the conventional toilet seat to further stabilize the device. After use, the front sections 16 and 18 are folded at hinge means 32 so that the flanges 46 are received within the hollow raised portions 48 of rear sections 12 and 14. The rear sections are then folded at hinge means 24 to provide a folded portable toilet seat.

The foldable, portable toilet seat can be used as a toilet training device for infants. The toilet seat of the present invention can also be used by travelers who want to insure sanitary toilet conditions.

It should be understood that various modifications, changes and variations in addition to those herein discussed may be made in the arrangement, operation and details of construction and assembly of the elements disclosed without departing from the spirit and scope of the invention.

What is claimed is:

1. A foldable toilet seat adapted to overlie a conventional toilet seat, said foldable toilet seat comprising a pair of front sections, each front section including a forward edge and a flange that extends downwardly at an angle from the forward edge thereof when placed over the conventional toilet seat; a pair of adjacent rear sections pivotably connected together at one end thereof, each of the rear sections being pivotably connected at another end thereof to one end of the corresponding front section and including a raised portion having a hollow interior adapted to receive the flange of the corresponding front section when the foldable seat is folded.

2. The foldable toilet seat according to claim 1 wherein the front and rear sections are pivotably connected by hinge means.

3. The foldable toilet seat according to claim 1 wherein the front and rear sections include upper and lower surfaces whereby the lower surface of one section overlaps the upper surface of an adjacent section.

4. The foldable toilet seat according to claim 1 including non-slip means on the lower surface of each section.

5. The foldable toilet seat according to claim 1 wherein the flange at the forward edge of each front section is adapted to engage the conventional toilet seat.

6. The portable toilet seat according to claim 1 wherein the seat is made from a lightweight, semi-rigid material.

7. The portable toilet seat according to claim 6 wherein the lightweight, semi-rigid material is a plastic.

8. A foldable toilet seat adapts to overlie a conventional toilet seat, said foldable toilet seat comprising a plurality of adjacent front and rear sections, the rear sections being pivotably connected together along a longitudinal axis and each rear section being pivotably connected along a transverse axis to the corresponding adjacent front section; each front section including a forward edge and a flange that extends downwardly at an angle from the forward edge thereof when placed over the conventional; and each rear section defining a raised portion having a hollow interior adapted to receive the flange of one of the corresponding front sections when the foldable seat is folded.

9. The foldable toilet seat according to claim 8 wherein the front and rear sections are pivotably connected by hinge means.

10. The foldable toilet seat according to claim 8 wherein the front and rear sections include upper and lower surfaces whereby the lower surface of one section overlaps the upper surface of an adjacent section.

11. The foldable toilet seat according to claim 8 including non-slip means on the lower surface of each section.

12. The foldable toilet seat according to claim 8 wherein the flange at the forward edge of each front section is adapted to engage the conventional toilet seat.

13. The portable toilet seat according to claim 8 wherein the seat is made from a lightweight, semi-rigid material.

14. The portable toilet seat according to claim 13 wherein the lightweight, semi-rigid material is a plastic.

15. A foldable toilet seat adapted to fit over a conventional toilet seat comprising:

a pair of rear sections having upper and lower surfaces and forward edges, said rear sections having contiguous edges defining a substantially longitudinal center of the seat;

a pair of front sections having upper and lower surfaces and rear edges contiguous with the forward edges of the rear sections to define a substantially transverse center of the seat and having confronting inner edges spaced apart to form a gap therebetween;

connecting means on the lower surfaces of the front and rear sections joining the contiguous edges of the rear sections and joining the forward edges of the rear sections with the corresponding rear edges of the front sections;

a flange extending downwardly from the lower surface of each front section to engage the conventional toilet seat; and a raised portion extending upwardly from the upper surface of each rear section and having a hollow interior that receives the flange from the corresponding front section when the sections are folded;

whereby the front sections are foldable against the rear sections along the transverse center of the seat and the rear sections, with the front sections folded therein, are foldable along the longitudinal center of the seat so that the front and rear sections are substantially parallel when folded.

16. The foldable toilet seat according to claim 15 wherein the connecting means comprises a plurality of hinges.

17. The foldable toilet seat according to claim 15 wherein the lower surface of one section overlaps the upper surface of an adjacent section at the connected edges.

18. The foldable toilet seat according to claim 15 including non-slip means on the lower surface of each section.

19. The portable toilet seat according to claim 15 wherein the seat is made from a lightweight, semi-rigid material.

20. The portable toilet seat according to claim 19 wherein the lightweight, semi-rigid material is a plastic.

* * * * *

UNITED STATES PATENT AND TRADEMARK OFFICE

CERTIFICATE OF CORRECTION

PATENT NO. : 5,005,223

DATED : April 9, 1991

INVENTOR(S) : Mark H. Greenwood

It is certified that error appears in the above-identified patent and that said Letters Patent is hereby corrected as shown below:

Claim 8, line 1, change "adapts" to --adapted--;

Claim 8, line 10, change "conventional;" to --conventional toilet seat;--.

Signed and Sealed this

Eighth Day of September, 1992

*Attest:*

DOUGLAS B. COMER

*Attesting Officer*

*Acting Commissioner of Patents and Trademarks*